US009605444B2

(12) United States Patent
Rickenbaugh et al.

(10) Patent No.: US 9,605,444 B2
(45) Date of Patent: Mar. 28, 2017

(54) ENTRY DOOR LATCH ACTUATOR SYSTEM

(71) Applicant: Amesbury Group, Inc., Amesbury, MA (US)

(72) Inventors: Allen Rickenbaugh, Sioux Falls, SD (US); Gary E. Tagtow, Sioux Falls, SD (US); Tracy Lammers, Sioux Falls, SD (US); Bruce Hagemeyer, Pella, IA (US)

(73) Assignee: Amesbury Group, Inc., Amesbury, MA (US)

( * ) Notice: Subject to any disclaimer, the term of this patent is extended or adjusted under 35 U.S.C. 154(b) by 0 days.

(21) Appl. No.: 14/860,433

(22) Filed: Sep. 21, 2015

(65) Prior Publication Data

US 2016/0083976 A1 Mar. 24, 2016

Related U.S. Application Data

(60) Provisional application No. 62/054,239, filed on Sep. 23, 2014.

(51) Int. Cl.

| | |
|---|---|
| ***E05B 3/00*** | (2006.01) |
| ***E05B 7/00*** | (2006.01) |
| ***E05C 9/12*** | (2006.01) |
| *E05B 63/04* | (2006.01) |
| *E05C 1/14* | (2006.01) |
| *E05C 3/08* | (2006.01) |
| *E05B 15/00* | (2006.01) |

(52) U.S. Cl.

CPC ..... *E05B 7/00* (2013.01); *E05C 9/12* (2013.01); *E05B 15/004* (2013.01); *E05B 63/04* (2013.01); *E05C 1/14* (2013.01); *E05C 3/08* (2013.01)

(58) Field of Classification Search

CPC ..... E05B 7/00; E05B 63/04; E05B 15/004; E05C 9/12; E05C 1/14; E05C 3/08

See application file for complete search history.

(56) References Cited

U.S. PATENT DOCUMENTS

| | | | | |
|---|---|---|---|---|
| 5,496,082 | A | 3/1996 | Zuckerman | |
| 5,728,108 | A | 3/1998 | Griffiths et al. | |
| 6,257,030 | B1 * | 7/2001 | Davis, III | E05B 7/00 292/39 |
| 6,564,596 | B2 * | 5/2003 | Huang | E05B 59/00 70/103 |

(Continued)

FOREIGN PATENT DOCUMENTS

| | | | |
|---|---|---|---|
| GB | 583655 | A | 12/1946 |
| JP | 2003343141 | A | 12/2003 |

OTHER PUBLICATIONS

PCT International Search Report and Written Opinion in International Application PCT/US2015/051500, mailed Jan. 22, 2016, 14 pgs.

*Primary Examiner* — Hanh V Tran

(57) ABSTRACT

An apparatus has a housing with a release lever and an actuation lever pivotably connected to the housing. A gear is pivotably disposed within the housing and a release rack is adapted to engage the release lever. A pivoting movement of the release lever linearly moves the release rack, which engages and rotates the gear in a first direction. An actuation rack is adapted to engage the actuation lever. A pivoting movement of the actuation lever linearly moves the actuation rack which engages and rotates the gear in a second direction.

16 Claims, 8 Drawing Sheets

(56) References Cited

U.S. PATENT DOCUMENTS

| | | | | |
|---|---|---|---|---|
| 7,748,759 | B2 * | 7/2010 | Chen | E05B 63/042 292/244 |
| 8,161,780 | B1 * | 4/2012 | Huml | E05B 15/02 292/142 |
| 2004/0107747 | A1 * | 6/2004 | Chang | E05B 65/1086 70/107 |
| 2006/0043742 | A1 * | 3/2006 | Huang | E05B 59/00 292/336.3 |
| 2009/0314042 | A1 * | 12/2009 | Fan | E05B 63/16 70/141 |
| 2011/0314877 | A1 * | 12/2011 | Fang | E05B 15/02 70/91 |
| 2013/0019643 | A1 | 1/2013 | Tagtow et al. | |
| 2013/0200636 | A1 | 8/2013 | Hagemeyer et al. | |

* cited by examiner

ENTRY DOOR LATCH ACTUATOR SYSTEM

CROSS-REFERENCE TO RELATED APPLICATIONS

This application claims priority to and the benefit of U.S. Provisional Patent Application Ser. No. 62/054,239, filed Sep. 23, 2014, entitled, "ENTRY DOOR LATCH ACTUATOR SYSTEM," the disclosure of which is hereby incorporated by reference herein in its entirety.

BACKGROUND

Typically, handle actuators for complex gearbox locks include a generally horizontal lever handle that is disposed substantially parallel to a door panel. When the lever handle is pivoted downward, an actuator in the gearbox lock rotates so as to retract a latch and one or more shoot bolts that are connected to the gear box lock. Once the latch and shoot bolts are retracted, the door may be opened. Once the door is again closed, the lever handle may be pivoted upward so as to extend the shoot bolts and secure the door panel. Although a horizontal lever handle can operate a gearbox lock satisfactorily, customers may prefer a more aesthetically pleasing handle for an entry door.

SUMMARY

In one aspect, the technology relates to an apparatus having: a housing; a release lever pivotably connected to the housing; an actuation lever pivotably connected to the housing; a gear pivotably disposed within the housing; a release rack adapted to engage the release lever, wherein a pivoting movement of the release lever linearly moves the release rack, so as to engage and rotate, in a first direction, the gear; and an actuation rack adapted to engage the actuation lever, wherein a pivoting movement of the actuation lever linearly moves the actuation rack, so as to engage and rotate, in a second direction, the gear. In an embodiment, the release rack is disengaged from the gear when the gear rotates in the second direction. In another embodiment, the actuation rack is disengaged from the gear when the gear rotates in the first direction. In yet another embodiment, the release lever moves the release rack in a first direction, and wherein the release rack is biased in a second direction opposite the first direction. In still another embodiment, the actuation lever moves the actuation rack in a third direction, and wherein the actuation rack is biased in a fourth direction opposite the third direction.

In another embodiment of the above aspect, the first direction and the third direction are substantially parallel. In an embodiment, the release lever pivots about a first axis and the actuation lever pivots about a second axis substantially parallel to the first axis. In another embodiment, the gear pivots about a third axis skew to both the first axis and the second axis. In yet another embodiment, the third axis extends from a plane defined by the first axis and the second axis. In still another embodiment, the release rack has a release rack projection and the release lever has a release lever projection, wherein the release rack projection and the release lever projection are adapted to engage upon pivoting movement of the release lever. In another embodiment, the actuation rack has an actuation rack projection and the actuation lever has an actuation lever projection, wherein the actuation rack projection and the actuation lever projection are adapted to engage upon pivoting movement of the actuation lever.

In another aspect, the technology relates to an apparatus having: a first lever; a first rack movably engaged with the first lever; a second lever; a second rack movably engaged with the second lever; and a gear selectively discretely engageable with both the first rack and the second rack, based at least in part on an actuation of the first lever and an actuation of the second lever, respectively. In an embodiment, the apparatus further includes an escutcheon, wherein the first lever and second lever are pivotably engageable with the escutcheon and wherein the first rack and the second rack are disposed within the escutcheon. In another embodiment, a first spring for biasing the first rack into a position is disengaged from the gear. In yet another embodiment, a second spring for biasing the second rack into a position is disengaged from the gear. In still another embodiment, the first lever and the second lever are pivotably engageable with the escutcheon about substantially parallel lever axes. In another embodiment, the gear is pivotably disposed in the escutcheon about a gear axis skew to the lever axes.

In another aspect, the technology relates to a method of actuating a lock mechanism, the method including: pivoting a first lever about a first axis so as to cause a rotation of a gear in a first direction, wherein pivoting the first lever locks the lock mechanism; and pivoting a second lever about a second axis so as to cause a rotation of the gear in a second direction, wherein pivoting the second lever unlocks the lock mechanism. In an embodiment, the first axis is substantially parallel to the second axis. In another embodiment, the gear rotates about a gear axis skew to the first axis and second axis.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

The same number represents the same element or same type of element in all drawings.

DETAILED DESCRIPTION

The entry door latch actuator system described herein may be utilized with a number of gearbox lock systems available from a variety of manufacturers. For example, the actuator system may be utilized with the P3000 lock system manufactured by Amesbury/Truth, of Sioux Falls, S. Dak. In another example, the actuator system may be utilized in conjunction with the locking system depicted in U.S. Published Patent Application No. 2013/0019643, the disclosure of which is hereby incorporated by reference herein in its entirety. This application is related to U.S. Published Patent Application No. 2013/0200636, the disclosure of which is hereby incorporated by reference herein in its entirety.

Figure 1A:
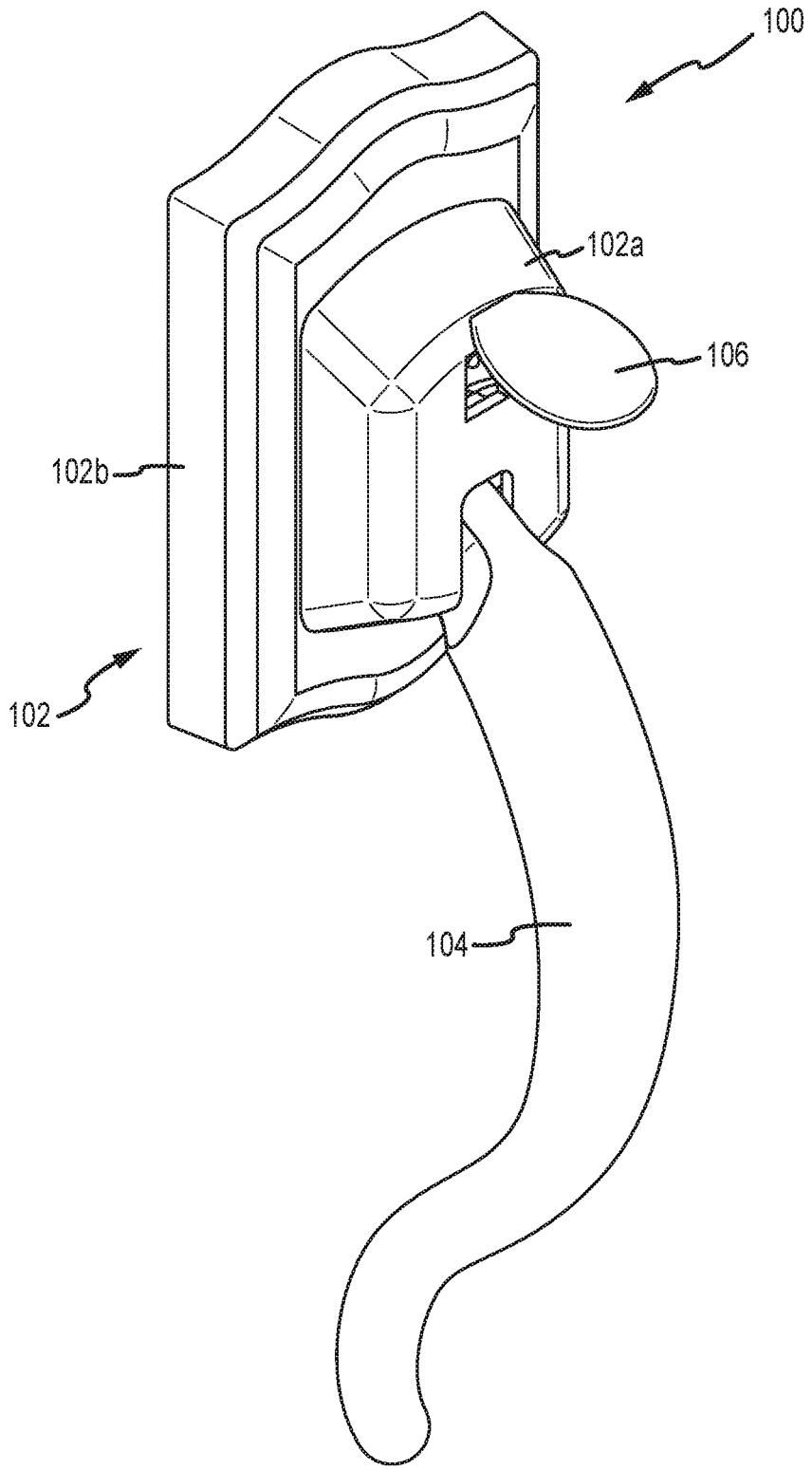
FIG. 1A depicts a front perspective view of an entry door latch actuator system.

FIG. 1A depicts a front perspective view of an entry door latch actuator system 100. The system 100 includes an escutcheon 102 and two levers pivotably connected thereto. An actuation lever 104 is disposed lower on the escutcheon 102, relative to a release lever 106. The levers 104, 106 are pivotably engaged with a raised portion 102*a* of the escutcheon 102. The raised portion 102*a* may be connected to a main portion 102*b* or the escutcheon 102 may be a single-piece component. The system 100 is configured to appear similar to an entry door lock actuator, as typical for residential building constructions. Thus, the actuator system 100 has a form factor visually similar to elaborate handle-type door actuators that are desirable by many consumers. However, the entry door latch actuator system 100 described herein has greater functionality.

Figure 1B:
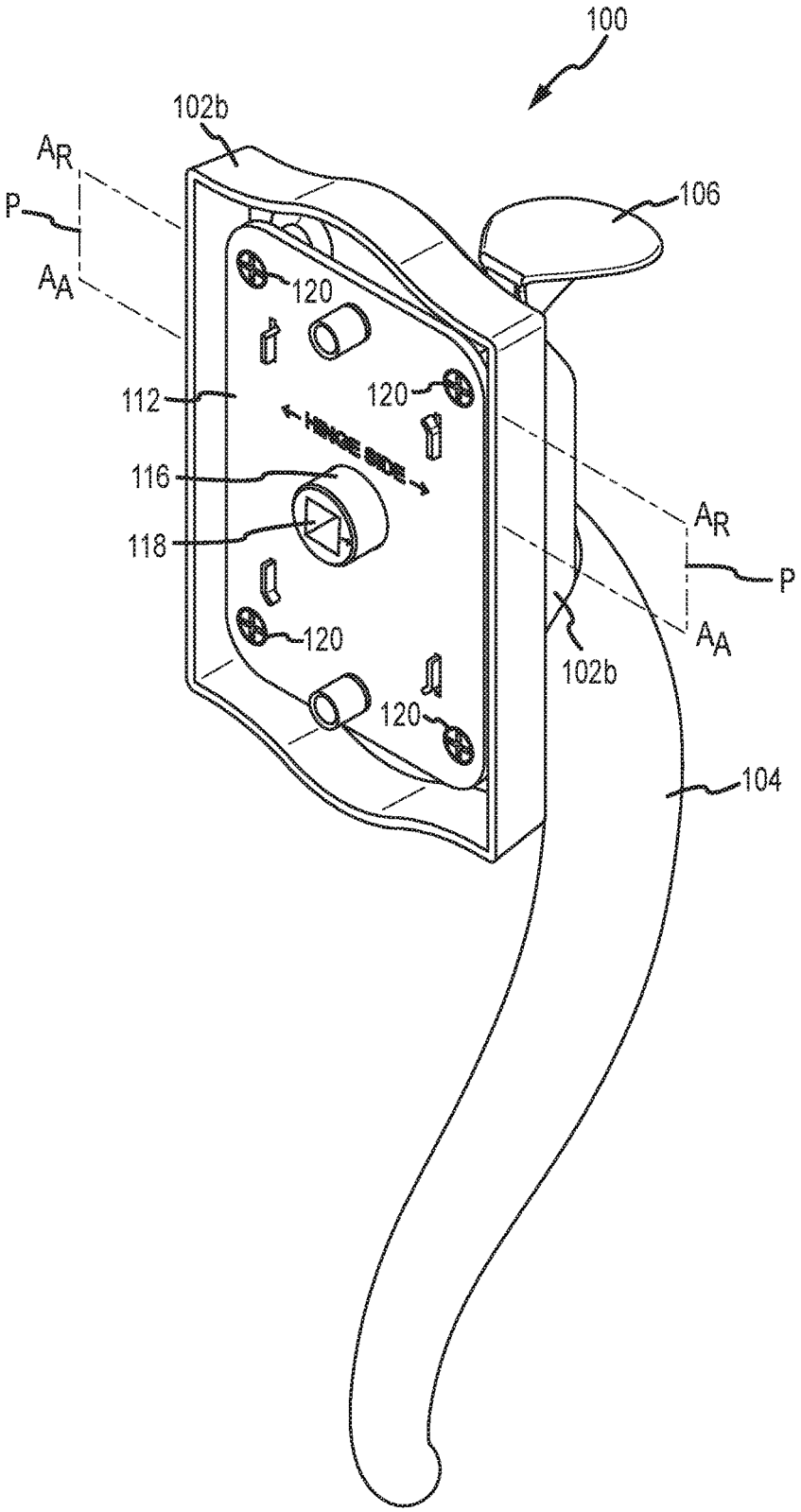
FIG. 1B depicts a rear perspective view of the entry door latch actuator system of FIG. 1A.
Figure 2:
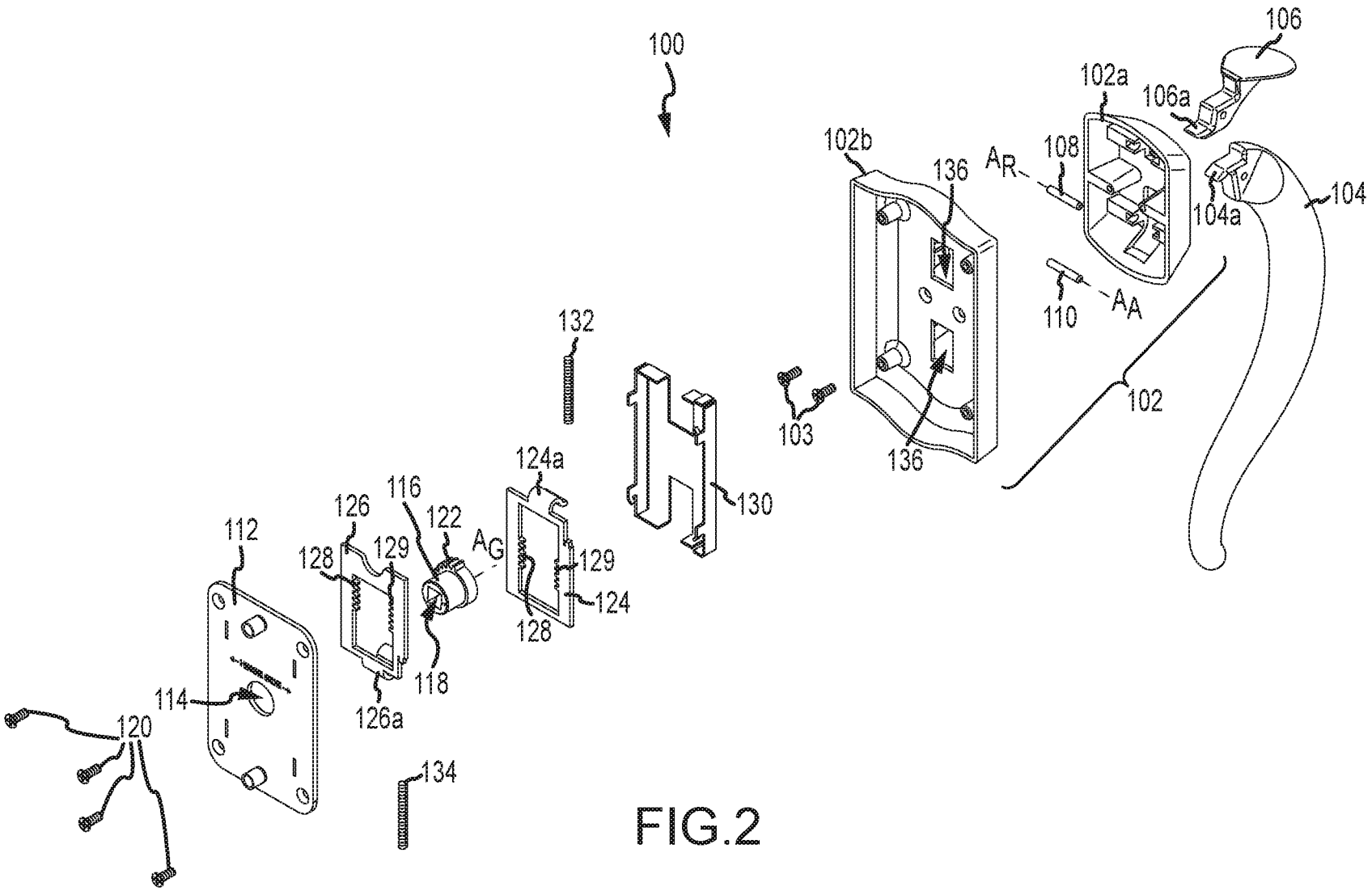
FIG. 2 depicts an exploded rear perspective view of the entry door latch actuator system of FIGS. 1A and 1B.

FIG. 1B depicts a rear perspective view of the entry door latch actuator system 100, while FIG. 2 depicts an exploded rear perspective view of the entry door latch actuator system 100. FIGS. 1B and 2 are described simultaneously. The actuator system 100 includes a housing 102 that may, in certain examples, be an escutcheon plate 102*b*, along with a raised escutcheon housing 102*a*. If the escutcheon plate 102*a* and escutcheon housing 102*a* are discrete from each other, they may be joined by bolts, screws, or other fasteners 103. Both a release or thumb lever 106 and an actuation or handle lever 104 are pivotably connected to the escutcheon housing 102*a* with pins 108, 110, respectively. The pin 108 forms an axis $A_R$ about which the release lever 106 pivots, while the pin 110 forms an axis $A_A$ about which the actuation lever 104 pivots.

The housing 102 contains a support plate 112 defining an opening 114 that receives a gear 116. The gear 116 may include a tailpiece (not shown) that fits within a tailpiece opening 118. The tailpiece is adapted to engage an actuator disposed in a gearbox lock system (not shown) such as the types described above. For example, in the gearbox lock depicted in U.S. Published Patent Application No. 2013/0019643, the tailpiece may extend into the actuator 306. Thus, rotation of the gear 116 rotates the actuator so as to operate the gearbox lock system, typically, the latch and shoot bolts. In other examples, the entry door latch actuator system 100 may be utilized to operate a deadbolt or other locking element. The support plate 112 is secured to the housing 102 with one or more screws, bolts, or other fasteners 120, so as to contain the components disposed therein. In the depicted example, the gear 116 includes teeth 122 disposed about only a portion of a circumference thereof. By disposing the teeth 122 about only a portion of the circumference of the gear 116, the gear 116 may be removed from the housing 102 prior to installation and flipped, such that the gear teeth 122 are disposed so as to engage opposite toothed portions 129 of each of the racks 124, 126 (described below), allowing the actuator system 100 to be used on either a left-hinged or a right-hinged door.

Two racks 124, 126 are disposed in the housing 102. A release rack 124 is, in the depicted example, disposed proximate the pivot pins 108, 110. An actuation rack 126 is disposed proximate the support plate 112. Each of the racks 124, 126 includes two toothed portions 128, 129, each described below, disposed on opposite sides of the body that defines each rack. During operation, as described below, only one set of rack teeth 128 on each rack 124, 126 is configured so as to engage the gear teeth 112 so as to rotate the gear 116 about a gear axis $A_G$. As can be seen in FIG. 1B, release axis $A_R$ and actuator axis $A_A$ are substantially parallel to each other and therefore define a plane P. Gear axis $A_G$ intersects this plane P and can, in certain examples, be disposed substantially orthogonal thereto. In other examples, the gear axis $A_G$ may be disposed at an angle to the plane P.

The racks 124, 126 substantially surround the gear 116. This configuration allows the position of the gear 116 to be reversed prior to installation so as to allow the actuator system 100 to be used on left-hinged or a right-hinged door. In alternative examples, each rack 124, 126 may only include a single set of rack teeth 128 disposed on a single side thereof. In such an example, the gear 116 may have gear teeth 122 present on an entire circumference thereof. To reverse the operation of the actuator system 100 in such an actuator, each rack 124, 126 may be flipped prior to installation such that the gear teeth 122 are disposed on an opposite side thereof, so as to allow the actuator system 100 to be used on left-hinged or a right-hinged door.

A housing frame 130 provides support for a number of biasing elements such as springs 132, 134. A release rack spring 132 biases the release rack 124 into a position opposite the force applied by the release lever 106, that is, in the depicted example, into a downward position. Similarly, an actuation spring 134 biases the actuation rack 126 into a position opposite the force applied by the actuation lever 104, that is, in the depicted example, into an upward position. Only a single one of each spring 132, 134 is depicted, however, multiple springs may be utilized. The release rack 124 and the release lever 106 each include a projection 124*a*, 106*a*, respectively. These projections 124*a*, 106*a* engage when the release lever 106 is depressed, for example, when a user depresses the release lever 106 so as to unlatch the lock system and retract the shoot bolts. In certain examples, the projections 124*a*, 106*a* may be in contact at all times, or may connected with a standard pivoting hinge (utilizing a tube and pin), a live hinge, or other connection system. In the depicted example, however, the projections 124*a*, 106*a* contact after a predetermined rotation of the release lever 106. Similar projections 126*a*, 104*a* are included on both of the actuation rack 126 and the actuation lever 104, respectively, and may be in contact as described above, or may be configured to contact during operation. The escutcheon plate 102*b* may define a plurality of openings 136 that allow passage of either or both of the projections 124*a*, 106*a* and either or both of the projections 126*a*, 104*a*, allowing for engagement thereof.

Figure 3:
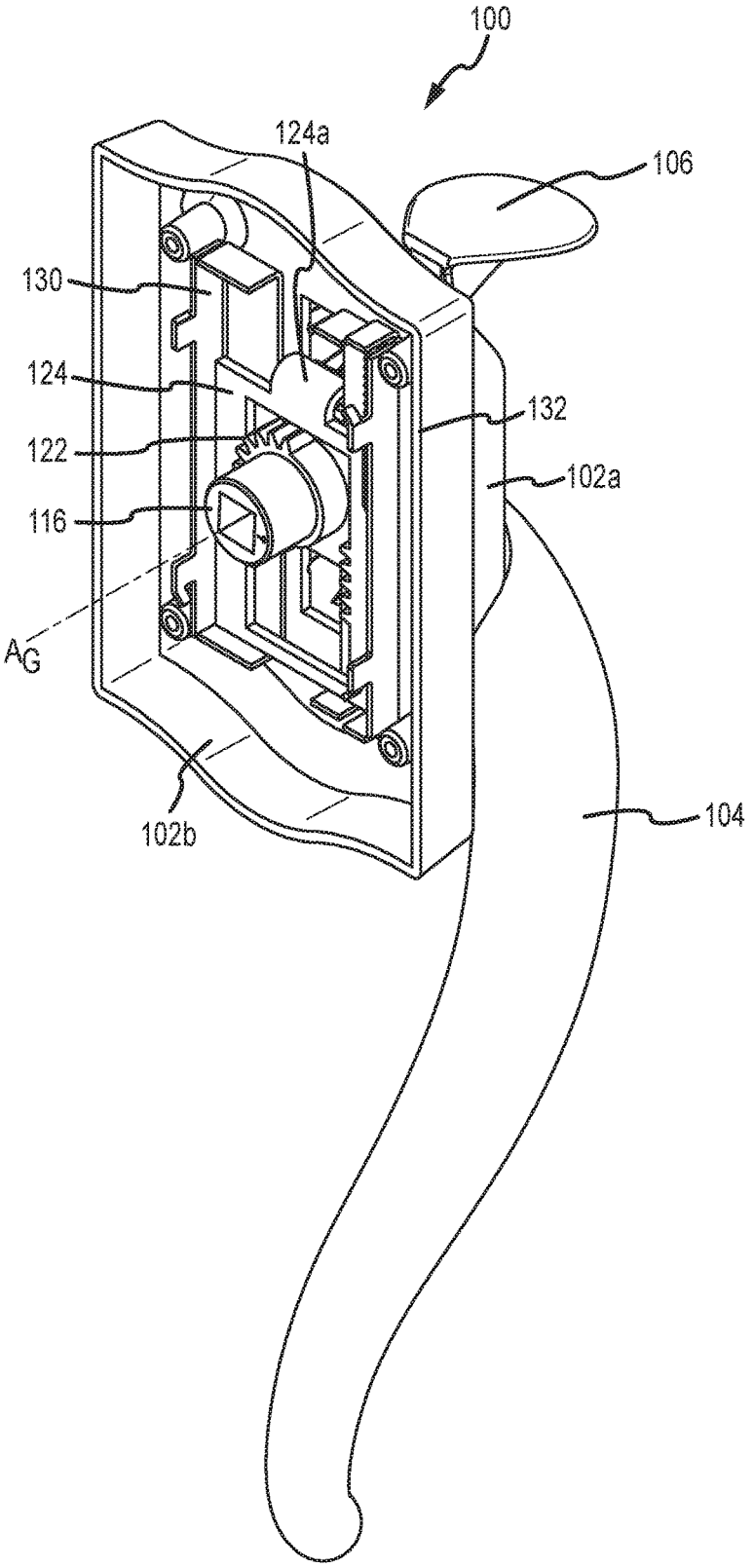
FIG. 3 depicts a partial rear perspective view of the entry door latch actuator system of FIGS. 1A-1B having a release lever in a rest position.
Figure 4:
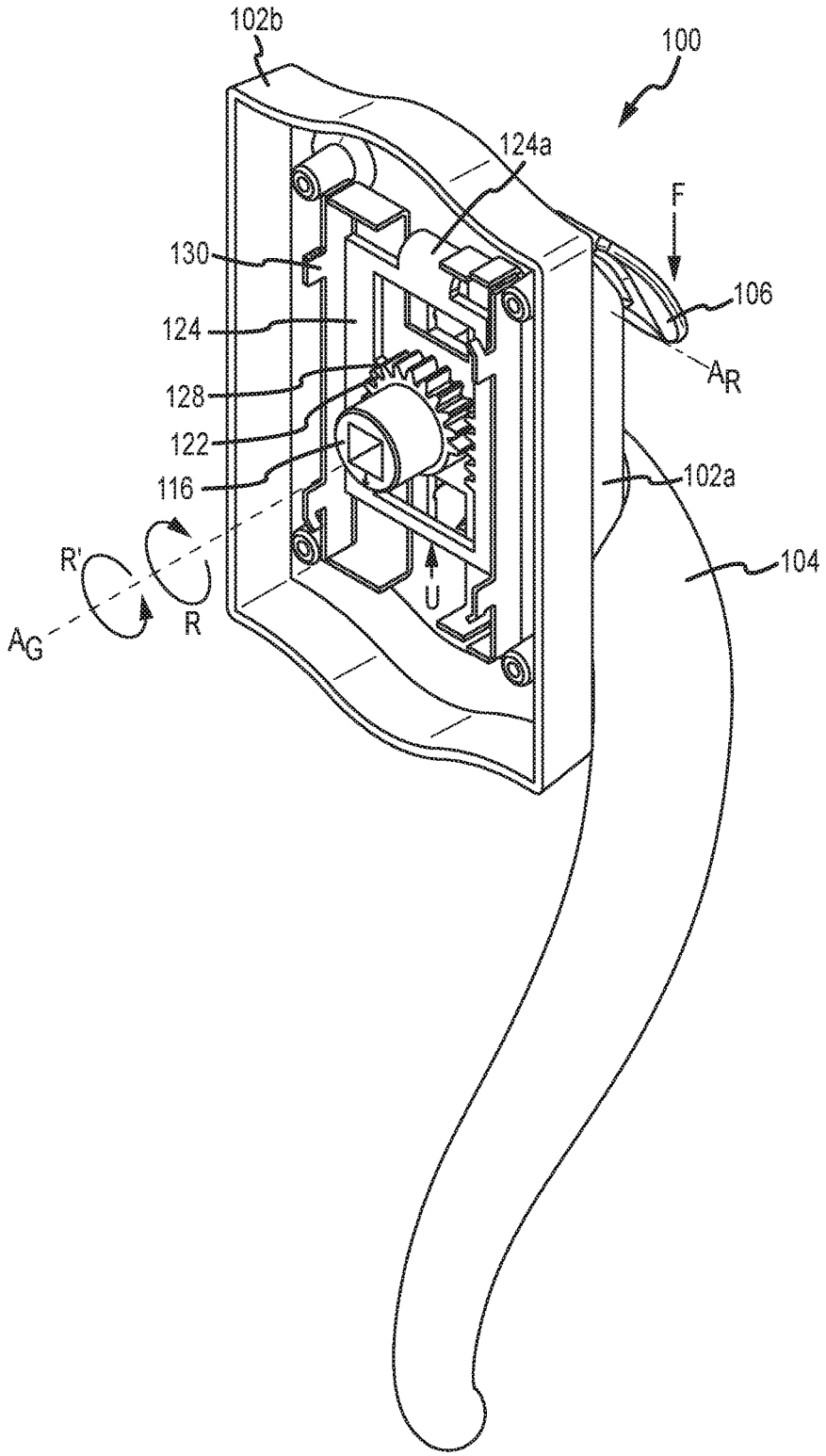
FIG. 4 depicts a partial rear perspective view of the entry door latch actuator system of FIGS. 1A-1B having the release lever in the released position.

Operation of the actuator system is depicted in FIGS. 3-6. In FIGS. 3 and 4, the support plate 112 and actuator rack 126 are not depicted for clarity. FIG. 3 depicts the release lever 106 in the rest position. As can be seen, in the rest position, the release rack 124 is biased by the release spring 132 into a down position. Due to contact between the release rack projection 124*a* and the release lever projection (not visible), the release lever 106 is disposed in an up position. FIG. 4 depicts the latch actuator system 100 with the release lever 106 in the release position, which in the depicted example, is reached when the release lever 106 is pivoted downward, typically by application of a force F on the release lever 106. Upon application of the force F, the release lever 106 pivots about the release axis $A_R$. As the release lever 106 pivots, the release lever projection (not visible) exerts an upward lifting force on the release rack 124, via the release rack projection 124*a*. As the release rack 124 moves linearly upward U, the release rack teeth 128 engages with the gear teeth 122, thus rotating R the gear 116 about the gear axis $A_G$. The actuator rack 126 is not engaged with the gear 116 during this rotation R. As such, the gear 116 is selectively disengageable from the actuator rack 112. Alignment of the release rack 124 through its range of motion is controlled by the frame 130, which acts as a guide for the release rack 124. Rotation R of the gear 116 unlatches the associated lock and retracts any shoot bolts utilized in conjunction therewith. The release lever 106 can then be released (e.g., the force F is removed therefrom) and returns to its rest position, due to the biasing effect of the release rack spring 132 on the release rack 124. By returning to the rest position, the gear 116 rotates R' opposite its original direction of rotation R to return to the rest position. The door is now unlatched and able to be opened.

Figure 5:
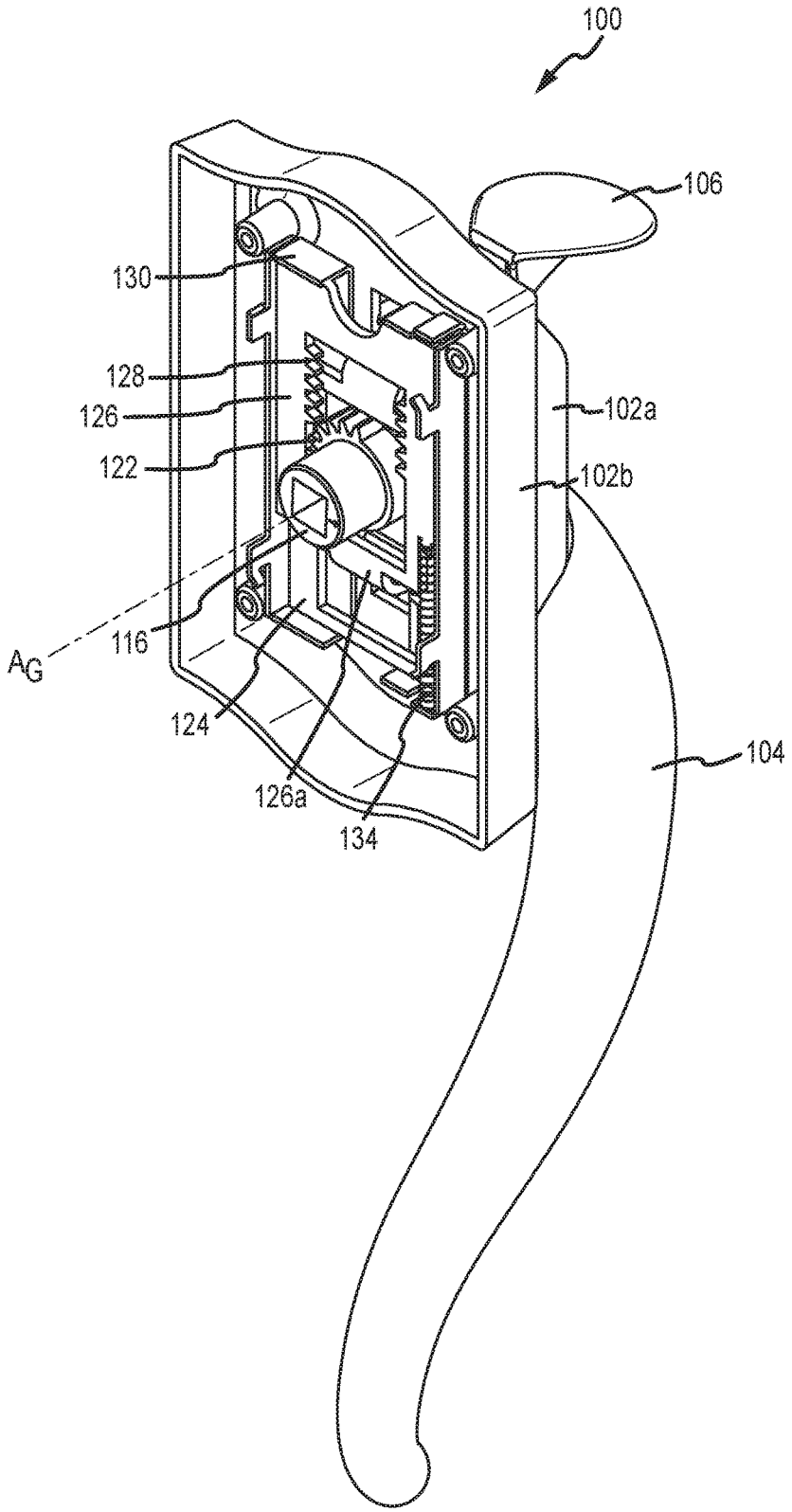
FIG. 5 depicts a partial rear perspective view of the entry door latch actuator system of FIGS. 1A-1B having an actuation lever in the rest position.
Figure 6:
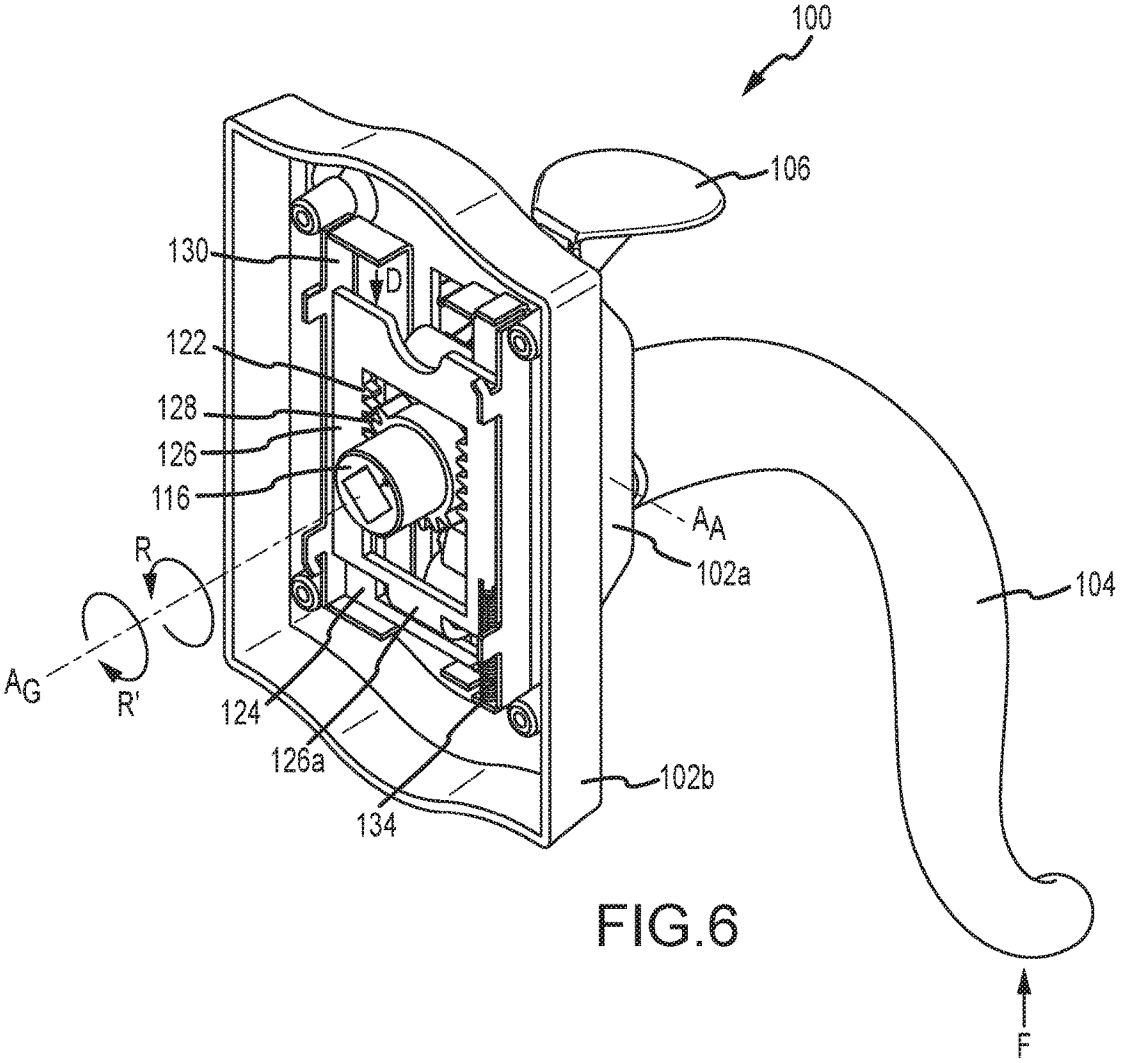
FIG. 6 depicts a partial rear perspective view of the entry door latch actuator system of FIGS. 1A-1B having the actuation lever in the actuated position.

In FIGS. 5 and 6, the support plate 112 is not depicted for clarity. FIG. 5 depicts the actuation lever 104 in the rest position, a down position. The actuation rack 126 is biased by the actuation spring 134 into an up position. Due to engagement between the actuation rack projection 126*a* and the actuation lever projection (not visible), the actuation lever 104 is in a down position. Neither of the release rack 124 nor the actuation rack 126 is engaged with the teeth 122 of the gear 116. As can be seen, the release rack 124 and the actuation rack 126 are disposed parallel to each other, with the gear axis $A_G$ disposed substantially orthogonal to both. FIG. 6 depicts the entry door latch actuator system 100 with the actuation lever 104 in the actuated position, which in the depicted example, is reached when the actuation lever 104 is pivoted upward, typically by application of a force F to the actuation lever 104. Upon application of the force F, the actuation lever 104 pivots about the actuator axis $A_A$. As the actuation lever 104 pivots, the actuation lever projection (not visible) engages with the actuation rack projection 126*a*, which exerts a downward force on the actuation rack 126. As the actuation rack 126 moves linearly downward D, the actuation rack teeth 128 engage with the gear teeth 122, thus rotating R the gear 116 about the axis $A_G$. The release rack 124 is not engaged with the gear 116 during this rotation R. As such, the gear 116 is selectively disengageable from the release rack 129. This latches the associated lock and extends any shoot bolts utilized in conjunction therewith. The actuation lever 104 can then be released and returns to its rest position, due to the biasing effect of the actuation rack spring 134 on the actuation rack 126. By returning to the rest position, the gear 116 rotates R' opposite its original direction of rotation R to return to the rest position. The door is now secured.

Figure 7:
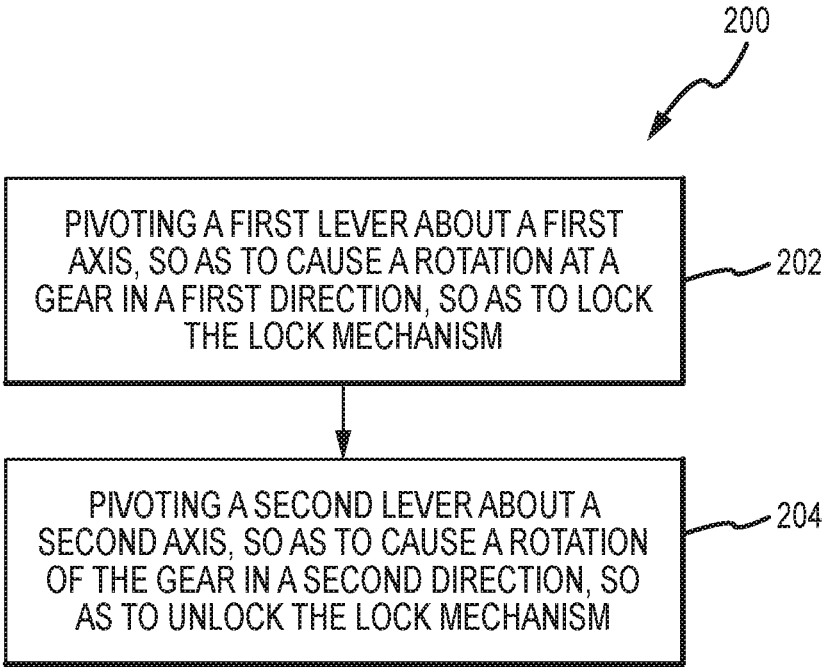
FIG. 7 depicts a method of actuating a lock mechanism.

FIG. 7 depicts a method 200 of actuating a lock mechanism. The method 200 begins with pivoting a first lever about a first axis, operation 202. This action causes a rotation of a gear in a first direction, thus locking the lock mechanism. In operation 204, a second lever is pivoted about a second axis. This action causes a rotation of the gear in a second direction, thus unlocking the lock mechanism. The first and second axis, about which the first and second levers, respectively, rotate, may be parallel to each other. The gear may rotate about an axis that is skew to both of the first and second axes, or orthogonal to a plane that is defined by both axes.

The materials utilized in the manufacture of the latch actuator system may be those typically utilized for lock and handle manufacture, e.g., zinc, steel, brass, stainless steel, etc. Material selection for most of the components may be based on the proposed use of the lock assembly, level of security desired, etc. Appropriate materials may be selected for a lock assembly used on sliding doors, or on doors that have particular security requirements, as well as on lock assemblies subject to certain environmental conditions (e.g., moisture, corrosive atmospheres, etc.). For particularly light-weight door panels or low-security panels, molded plastic, such as PVC, polyethylene, etc., may be utilized for the various components. Nylon, acetal, Teflon®, or combinations thereof may be utilized for various components to reduce friction, although other low-friction materials are contemplated. The levers and escutcheon may also be finished by known powder coating processes.

The terms first, second, retracted, extended, latched, unlatched, locked, unlocked, upper, lower, etc., as used herein, are relative terms used for convenience of the reader and to differentiate various elements of the latch actuator system from each other. In general, unless otherwise noted, the terms are not meant to define or otherwise restrict location of any particular element or the relationship between any particular elements. The latch actuator systems described herein may be utilized in new doors or may be retrofitted into existing installations.

The latch actuator systems depicted herein may be sold in a kit including the components necessary to construct a complete door lock using a locking mechanism and a latch actuator system. In certain examples, the kit may include a release lever, an actuation lever, an escutcheon, a gear, and racks, and any required connectors or fasteners. Additionally, the elements of the latch actuation system may be sold as a kit separate from a locking mechanism to enable easy retrofitting of the latch actuation system onto an existing door with an existing lock mechanism. Multiple tailpieces of different lengths may be included in the kit such that a tailpiece of the correct length may be field-selected for a door having a particular thickness (e.g., deep or shallow).

This disclosure described some examples of the present technology with reference to the accompanying drawings, in which only some of the possible examples were shown. Other aspects may, however, be embodied in many different forms and should not be construed as limited to the examples set forth herein. Rather, these examples were provided so that this disclosure was thorough and complete and fully conveyed the scope of the possible examples to those skilled in the art.

Although specific examples were described herein, the scope of the technology is not limited to those specific examples. One skilled in the art will recognize other examples or improvements that are within the scope and spirit of the present technology. Therefore, the specific structure, acts, or media are disclosed only as illustrative examples. The scope of the technology is defined by the following claims and any equivalents therein.

What is claimed is:

1. An apparatus comprising:

a housing;

a release lever pivotably connected to the housing;

an actuation lever pivotably connected to the housing;

a gear pivotably disposed within the housing;

a release rack adapted to engage the release lever, wherein a pivoting movement of the release lever linearly moves the release rack, so as to engage and rotate, in a first direction, the gear; and an actuation rack adapted to engage the actuation lever, wherein a pivoting movement of the actuation lever linearly moves the actuation rack, so as to engage and rotate, in a second direction, the gear, and wherein the release rack is disengaged from the gear when the gear rotates in the second direction.

2. The apparatus of claim 1, wherein the actuation rack is disengaged from the gear when the gear rotates in the first direction.

3. The apparatus of claim 1, wherein the release lever moves the release rack in a third direction, and wherein the release rack is biased in a fourth direction opposite the third direction.

4. The apparatus of claim 3, wherein the actuation lever moves the actuation rack in a fifth direction, and wherein the actuation rack is biased in a sixth direction opposite the fifth direction.

5. The apparatus of claim 4, wherein the third direction and the fifth direction are substantially parallel.

6. The apparatus of claim 1, wherein the release lever pivots about a first axis and the actuation lever pivots about a second axis substantially parallel to the first axis.

7. The apparatus of claim 6, wherein the gear pivots about a third axis skew to both the first axis and the second axis.

8. The apparatus of claim 7, wherein the third axis extends from a plane defined by the first axis and the second axis.

9. The apparatus of claim 1, wherein the release rack comprises a release rack projection and the release lever comprises a release lever projection, wherein the release rack projection and the release lever projection are adapted to engage upon pivoting movement of the release lever.

10. The apparatus of claim 1, wherein the actuation rack comprises an actuation rack projection and the actuation lever comprises an actuation lever projection, wherein the actuation rack projection and the actuation lever projection are adapted to engage upon pivoting movement of the actuation lever.

11. An apparatus comprising:

a first lever;

a first rack movably engaged with the first lever;

a second lever;

a second rack movably engaged with the second lever;

an escutcheon, wherein the first lever and second lever are pivotably engageable with the escutcheon and wherein the first rack and the second rack are disposed within the escutcheon; and a gear selectively discretely engageable with both the first rack and the second rack, based at least in part on an actuation of the first lever and an actuation of the second lever, respectively.

12. The apparatus of claim 11, further comprising a first spring for biasing the first rack into a position disengaged from the gear.

13. The apparatus of claim 12, further comprising a second spring for biasing the second rack into a position disengaged from the gear.

14. The apparatus of claim 11, wherein the first lever and the second lever are pivotably engageable with the escutcheon about substantially parallel lever axes.

15. The apparatus of claim 14, wherein the gear is pivotably disposed in the escutcheon about a gear axis skew to the lever axes.

16. A method of actuating a lock mechanism, the method comprising: pivoting a first lever about a first axis so as to cause a rotation of a gear in a first direction, wherein pivoting the first lever locks the lock mechanism; and pivoting a second lever about a second axis so as to cause a rotation of the gear in a second direction, wherein pivoting the second lever unlocks the lock mechanism, and wherein the first axis is substantially parallel to the second axis, and wherein the gear rotates about a gear axis skew to the first axis and second axis.

* * * * *